US005848854A

United States Patent [19]

Brackett

[11] Patent Number: 5,848,854

[45] **Date of Patent: *Dec. 15, 1998**

[54] TURBINE NOZZLE RETAINER ASSEMBLY

[75] Inventor: Norman C. Brackett, N. Reading, Mass.

[73] Assignee: General Electric Company, Cincinnati, Ohio

[ * ] Notice: The term of this patent shall not extend beyond the expiration date of Pat. No. 5,669,757.

[21] Appl. No.: 861,875

[22] Filed: May 22, 1997

Related U.S. Application Data

[62] Division of Ser. No. 565,709, Nov. 30, 1995, Pat. No. 5,669,757.

[51] Int. Cl.[6] ..... F16D 1/00

[52] U.S. Cl. ..... 403/327; 403/DIG. 7; 415/209.2

[58] Field of Search ..... 415/209.2, 209.3, 415/209.4, 210.1; 403/327, DIG. 7

[56] References Cited

U.S. PATENT DOCUMENTS 5,622,475 4/1997 Hayner et al. ..... 416/220 R 5,669,757 9/1997 Brackett ..... 415/209.2

FOREIGN PATENT DOCUMENTS 3102558 3/1983 Germany ..... 403/DIG. 7

*Primary Examiner*—John T. Kwon

*Attorney, Agent, or Firm*—Andrew C. Hess; David L. Narciso

[57] ABSTRACT

A turbine nozzle assembly includes an outer casing having first and second spaced apart support flanges for supporting a nozzle segment including a plurality of nozzle vanes extending between inner and outer bands. The outer band includes first and second spaced apart retention hooks, with the first hook being configured to axially engage the first support flange. And, the second support flange is sized for axially receiving the second hook without tilting of the nozzle segment. An annular retainer radially engages the second support flange and axially abuts the second hook for axially retaining the second hook. And, a clip axially engages the second hook and support flange around the retainer for radially supporting the nozzle segment to the outer casing.

10 Claims, 3 Drawing Sheets

TURBINE NOZZLE RETAINER ASSEMBLY

This application ia a division of application Ser. No. 08/565,709, issued as U.S. Pat. No. 5,669,757, filed Nov. 30, 1995.

The U.S. Government has rights in this invention in accordance with contract No. N00019-91-C-0114 awarded by the Department of the Navy.

BACKGROUND OF THE INVENTION

The present invention relates generally to gas turbine engines, and, more specifically, to turbine nozzles therein.

In a typical gas turbine engine, air is compressed in a compressor and mixed with fuel and ignited in a combustor for generating hot combustion gases. The gases flow downstream through a high pressure turbine (HPT) having one or more stages including a turbine nozzle and rotor blades. The gases then flow to a low pressure turbine (LPT) which typically includes multi-stages with respective turbine nozzles and rotor blades. Each turbine nozzle includes a plurality of circumferentially spaced apart stationary nozzle vanes supported between radially outer and inner bands. Each turbine stage includes a plurality of circumferentially spaced apart rotor blades extending radially outwardly from a rotor disk which carries torque developed during operation.

The LPT nozzles are typically formed in arcuate segments having a plurality of vanes integrally joined between corresponding segments of the outer and inner bands. Each nozzle segment is supported by its radially outer end to an annular outer casing. The outer casing includes a pair of axially spaced apart support flanges typically in the form of hooks which engage a pair of complementary retention hooks formed integrally with the nozzle segment outer bands. In one conventional design, each nozzle segment is axially assembled into the outer casing and requires tilting or rocking with the inner band temporarily being displaced further axially forwardly than the outer band to allow the aft retention hook to clear its corresponding aft support flange in the casing for suitable assembly therewith. The nozzle segment is then returned to its upright position to engage the aft hook with the aft flange, and then a conventional C-clip is installed to radially retain the aft hook to the aft flange. The forward hook and forward flange are typically in the form of a conventional axial tongue and groove arrangement which radially support the forward end of the nozzle segment.

The tilting of the nozzle segment during assembly is required since the aft hook and support flange are configured for engaging together to provide axial stops which prevent axially forward and aft movement of the nozzle segments during operation. During operation, combustion gases flow between the nozzle vanes and create an aft directed force which must be carried by the aft hooks into the aft support flanges. Various configurations for these components are known in which either the aft hook has a U-shaped slot which engages a complementarily configured aft support flange for restraining axial forward and aft movement. Or, the aft support flange includes a generally U-shaped slot in which a complementarily configured aft hook engages for again restraining axial forward and aft movement. This radial tongue and groove type joint therefore necessarily requires tilting of the nozzle segments during the assembly process for engaging the aft hooks and support flange.

In an advanced gas turbine engine being developed, the axial clearance between HPT shrouds, which surround the rotor blades, and the LPT nozzle is too small for allowing rocking of the LPT nozzle during assembly, and providing a larger clearance is unacceptable since this would increase the available leakage path therebetween which would complicate the required sealing design therefor to prevent either hot combustion gas flow into the surrounding shroud area, or increase cooling air purge flow from the shroud area into the gas flow path. The shrouds surrounding the turbine blades adjoin the nozzle outer bands to provide an effective seal therebetween for maximizing aerodynamic performance of the engine. Since the blade shrouds are assembled to the outer casing prior to assembly of the nozzle segments, an improved retention assembly for the nozzle segments is required which will maintain a suitably small axial clearance between the outer bands thereof and the adjacent blade shrouds, while allowing assembly of the nozzle segments without tilting.

SUMMARY OF THE INVENTION

A turbine nozzle assembly includes an outer casing having first and second spaced apart support flanges for supporting a nozzle segment including a plurality of nozzle vanes extending between inner and outer bands. The outer band includes first and second spaced apart retention hooks, with the first hook being configured to axially engage the first support flange. And, the second support flange is sized for axially receiving the second hook without tilting of the nozzle segment. An annular retainer radially engages the second support flange and axially abuts the second hook for axially retaining the second hook. And, a clip axially engages the second hook and support flange around the retainer for radially supporting the nozzle segment to the outer casing.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
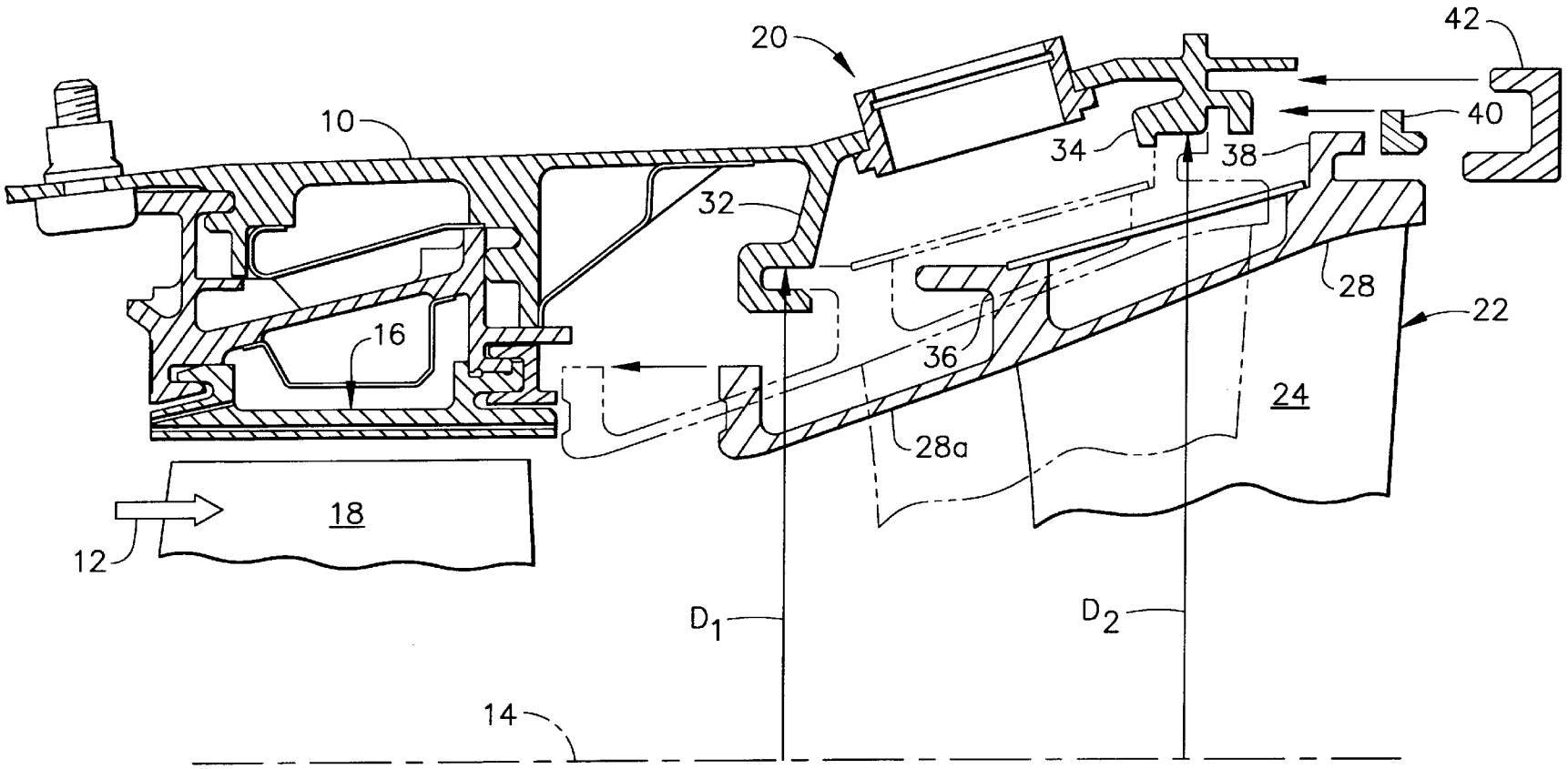
FIG. 1 is an elevational partly sectional view of a gas turbine engine LPT nozzle in accordance with one embodiment of the present invention shown in partly exploded view axially downstream of an HPT rotor stage.

Illustrated in FIG. 1 is a portion of an annular outer casing 10 of a turbine section of a gas turbine engine in which air is compressed in a compressor and mixed with fuel in a combustor (not shown) and ignited for generating hot combustion gases 12 which flow in an axial downstream direction. The casing 10 includes an axial centerline axis 14, and conventional HPT blade shrouds 16 are conventionally removably joined to a forward portion of the casing 10 radially above a plurality of conventional HPT rotor blades 18, only the tip portion of which is illustrated. The blades 18 extend radially outwardly from a conventional rotor disk (not shown) which is disposed coaxially with the axis 14.

Figure 2:
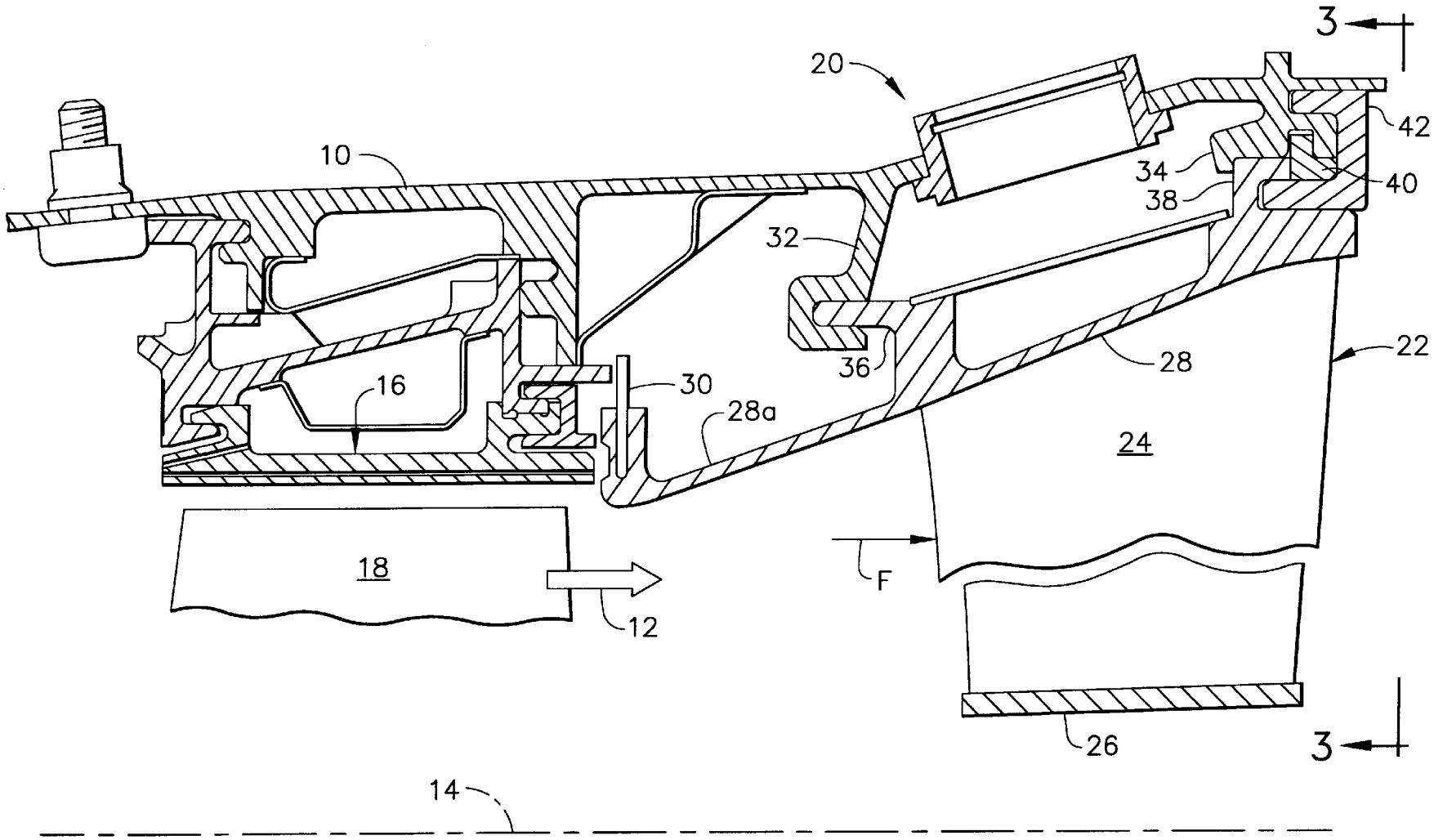
FIG. 2 is an elevational partly sectional view of the HPT and LPT adjoining stages illustrated in FIG. 1 with an exemplary LPT nozzle segment being finally assembled to the outer casing.
Figure 3:
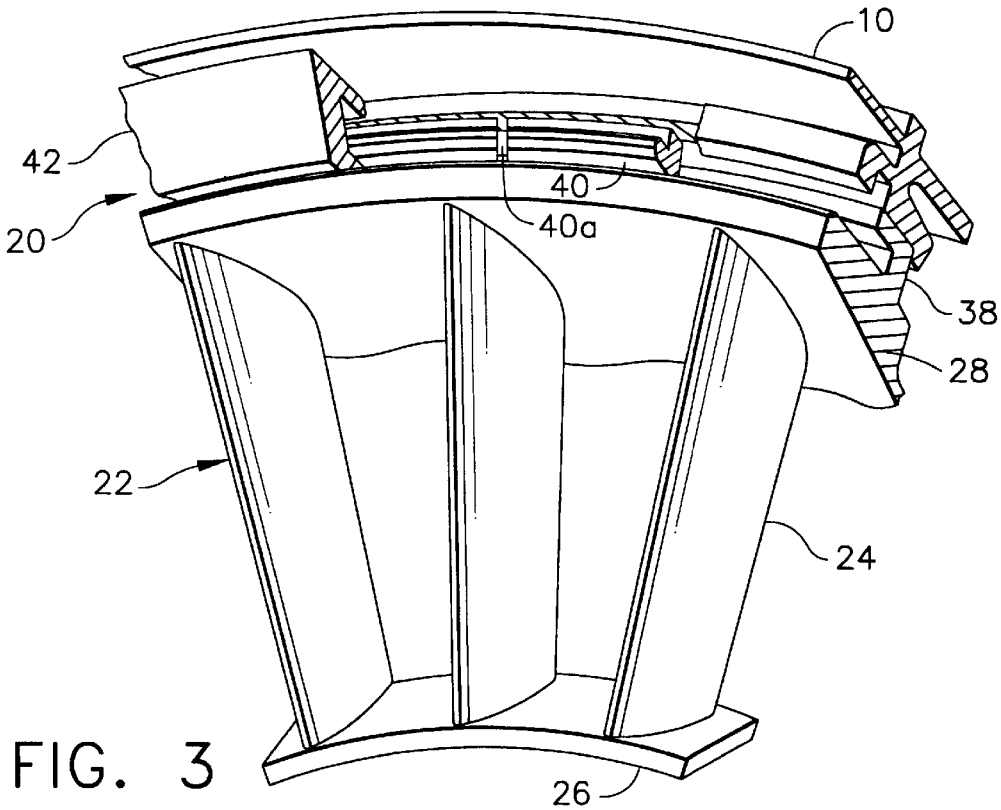
FIG. 3 is a forward facing end view of one of a plurality of circumferentially adjoining nozzle segments joined to the outer casing illustrated in FIG. 2 and taken generally along line 3—3.

Disposed axially downstream or aft of the HPT shroud 16 and blades 18 is an LPT nozzle assembly 20 in accordance with an exemplary embodiment of the present invention. The assembly 20 includes a plurality of circumferentially adjoining nozzle segments 22 shown during assembly in FIG. 1, after assembly in FIG. 2, and in end view in FIG. 3. As best shown in FIG. 3, each nozzle segment 22 includes a plurality of circumferentially spaced apart nozzle vanes 24, three for example, extending radially between radial inner and outer arcuate bands 26, 28 formed integrally therewith. The outer band 28 in this exemplary embodiment includes an integral forward extension 28*a,* as shown in FIG. 2, which upon final assembly of the nozzle segment 22 with the outer casing 10 is disposed closely adjacent to the aft end of the blade shrouds 16. The extension 28*a* includes a conventional flexible leaf seal 30 which prevents backflow escape of the combustion gases 12 into the cavity surrounding the extension 28*a,* and also limits the amount of cooling air purge flow from the cavity above the extension 28*a* into the hot combustion flowpath.

Since it is desirable to maintain the clearance between the blade shrouds 16 and the outer band extension 28*a* as small as possible to maximize turbine efficiency, it is not possible to mount the nozzle segments 22 to the outer casing 10 in a conventional manner which would require tilting of the nozzle segment 22 by initially displacing the inner band 26 axially forwardly to a greater extent than the outer band 28 which is prevented by the small clearance between the extension 28*a* and blade shrouds 16.

In accordance with one embodiment of the present invention, the outer casing 10 as illustrated in FIG. 1 includes first or forward and second or aft radially inwardly extending and axially spaced apart annular support flanges 32 and 34 to which the outer bands 28 of the several nozzle segments 22 are mounted. Each outer band 28 correspondingly includes first or forward and second or aft radially outwardly extending and axially spaced apart retention hooks 36 and 38.

The first hook 36 is configured to axially engage the first support flange 32 in a conventional axially configured tongue and groove arrangement for radially supporting the forward end of the nozzle segment 22. The first hook 36 has an axially forwardly extending tongue which is axially inserted into an aft facing groove of the first support flange 32.

In accordance with the present invention, the second flange 34 and second hook 38 are specifically sized and configured for allowing each nozzle segment 22 to be assembled into the outer casing 10 by solely axial translation therebetween as illustrated in FIG. 1 between the solid and phantom line positions of the nozzle segment 22, without axial tilting of the nozzle segment 22 during assembly. The first support flange 32 and the first hook 36 have a nominal diameter $D_1$ relative to the centerline axis 14 which is preferably less than a nominal second diameter $D_2$ of the second support flange 34 and the second support hook 38 where they engage, as illustrated in FIG. 1, for allowing the first hook 36 to be axially translated into position without obstruction by the second support flange 34.

During assembly, an axial portion of the second hook 38 as illustrated in FIG. 1 is axially translated along a corresponding portion of the second support flange 34. A discrete annular retainer 40 as shown in FIG. 1 is then assembled to radially engage the second support flange 34 and axially abut the second hook 38 for axially retaining the second hook 38 as shown in FIG. 2. An annular C-PATENT sectioned clip 42 axially engages the second hook 38 and support flange 34 around the retainer 38 for radially supporting the aft end of the nozzle segment 22 as shown in FIG. 2.

Figure 4:
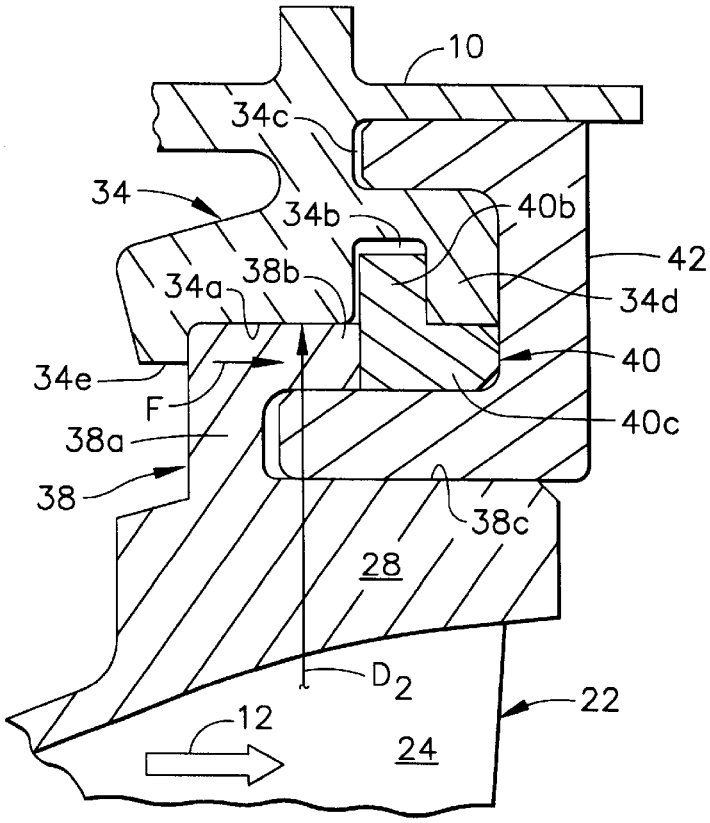
FIG. 4 is an elevational enlarged view of an aft retention hook of the nozzle segment illustrated in FIG. 2 joined to a corresponding aft support flange of the outer casing in accordance with one embodiment of the present invention.

The second support flange 34 and second hook 38 are illustrated in more particularity in FIG. 4 in final assembly with the retainer 40 and clip 42. In accordance with the present invention, the second hook 38 includes a radial leg 38*a* extending outwardly from the outer band 28, and an integral axial leg 38*b* spaced radially above the outer band 28 to define an axial inner slot 38*c* therebetween. The axial leg 38*b* and the inner slot 38*c* face oppositely away from the first hook 36 illustrated in FIG. 2 in the axially aft direction.

The second support flange 34 illustrated in FIG. 4 includes at a radially inner end thereof a flat axial seat 34*a* for receiving the axial leg 38*b* of the second hook 38. The second flange 34 also includes a radially inwardly facing slot 34*b* which adjoins the aft end of the axial seat 34*a* for radially receiving a portion of the retainer 40 and for additionally axially abutting the hook axial leg 38*b*. The second flange 34 further includes an aft facing axial outer slot 34*c* disposed above the radial slot 34*b* and the retainer 40. The C-clip 42 has axially forwardly extending legs which axially engage the inner and outer slots 38*c* and 34*c* to radially retain the aft end of the nozzle segment 22, as well as entrap or retain the retainer 40 in the radial slot 34*b*.

The outer casing 10 and nozzle segments 22 are stationary components through which pressure force F is carried during operation. In FIG. 2, the pressure force is designated by the arrow labeled F which acts in an aft direction on the nozzle vanes 24 which in turn is carried through the outer bands 28 and aft hooks 38 into the aft support flange 34 of the outer casing 10. The retainer 40 itself is configured and used to define an axially aft stop for retaining the second hook 38, and correspondingly the entire nozzle segment 22, against axially aft movement during operation against the application of the pressure force. The retainer 40 must also be capable of carrying the substantial pressure force from the aft hooks 38 and into the corresponding aft support flange 34. In the preferred embodiment illustrated in FIG. 3 for example, the retainer 40 is in the form of a ring having a single circumferential split 40*a* which allows the retainer to be elastically deflected for being radially inserted into the radial slot 34*b* during assembly. In alternate embodiments the retainer 40 may comprise arcuate segments individually inserted into the radial slot 34*b,* with subsequent assembly of the clip 42 capturing the segmented retainer in the radial slot 34*b*.

Referring again to FIG. 4, the retainer 40 is preferably L-shaped in axial section and includes a radial stem 40*b* disposed in the radial slot 34*b* of the second support flange 34, and an integral axial stem 40*c* extending axially aft from the radially inner end of the radial stem 40*b*.

The second support flange 34 preferably also includes a radially inwardly extending rib or lip 34*d* which defines in part the radial slot 34*b* for radially abutting the retainer axial stem 40*c* and reacting loads therefrom carried by the axial leg 38*b* of the second hook 38 during operation of the nozzle segment 22. As shown in FIG. 4, the operational pressure forces F include an axial component which is carried through the hook axial leg 38*b* which abuts the lower portion of the retainer 40. A portion of the pressure force F is carried axially through the abutting portions of the retainer radial stem 40*b* into the lip 34*d* of the aft support flange 34. The pressure force F also develops a counterclockwise moment in the retainer 40 which is reacted through the retainer axial stem 40*c* which radially abuts the lower portion of the lip 34*d*. In this way, the pressure force F is effectively carried through the L-shaped retainer 40 into the second support flange 34. The lower leg of the clip 42 entraps the retainer fully in the radial slot 34*b* and against the lip 34*d* which contributes to the effective transfer of the pressure force F through the nozzle segment 22 into the outer casing 10.

As shown in FIG. 4, the lip 34*d* has an inner diameter which is preferably at least as large as the inner diameter $D_2$ of the seat 34*a* for allowing the second hook 38 to be axially inserted along the seat 34*a* without tilting of the nozzle segment 22. The assembled retainer 40 then defines an axially aft stop for retaining the second hook 38. The second support flange 34 preferably also includes a forward axial stop 34*e* in the form of a radially inwardly extending lip or ridge disposed at the axially forward end of the seat 34*a* for retaining the second hook 38 against axially forward movement. The forward stop 34*e* and assembled retainer 40 retain the second hook 38 against axially forward and aft movement, respectively.

Accordingly, the improved design of the aft hook 38 and aft support flange 34 including the cooperating retainer 40 and C-clip 42 allow the individual nozzle segments 22 to be assembled in a straight axial motion or path into position in the outer casing 10 adjacent to the preassembled blade shrouds 16 without requiring tilting of the nozzle segments 22 in conventional designs. In this way, the outer band forward extension 28*a* as shown in FIGS. 1 and 2 may be more closely positioned adjacent to the blade shrouds 16 for providing a more effective seal thereat. Since rocking of the nozzle segments 22 is not required, an added benefit of the present invention is the simplification of the required tooling which is used in the assembly process.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. A retainer for axially retaining a gas turbine engine nozzle segment in an outer casing having a radially inwardly facing slot, and comprising a ring being L-shaped in section and including integral radial and axial stems, and with said radial stem being sized to engage said slot.

2. A retainer for axially retaining a gas turbine engine nozzle segment in an outer casing which includes axially spaced apart first and second support flanges for engaging corresponding first and second retention hooks of said nozzle segment, said retainer comprising:

a ring being L-shaped in section and including integral radial and axial stems; and said retainer stem extends radially outwardly from said axial stem for engaging a complementary radial slot of said second support flange.

3. A retainer according to claim 2 in the form of a ring having a single circumferential split.

4. A retainer for retaining a turbine nozzle segment in an outer casing comprising a ring including:

first means for radially engaging a radial slot in said casing and axially abutting said nozzle segment; and second means integrally joined with said first means for radially abutting said casing for reacting moment carried through said retainer from said nozzle segment.

5. A retainer according to claim 4 wherein said first means are sized to extend radially outwardly from said nozzle segment and second means for allowing axial assembly of said nozzle segment, into said casing without tilting thereof.

6. A turbine nozzle retainer for permitting axial assembly of a turbine nozzle segment in an outer casing without tilting, comprising:

a ring having a radial stem for radially engaging said casing and for axially abutting said nozzle segment, and an integral axial stem for radially abutting said casing for reacting moment carried through said retainer from said nozzle segment.

7. A retainer according to claim 6 wherein said casing includes a radially inwardly extending support flange having a radially inwardly facing radial slot, and said radial stem is sized to engage said slot, with said axial stem radially abutting said flange.

8. A retainer according to claim 7 wherein said axial and radial stems are straight for respectively abutting said support flange when engaged therewith.

9. A retainer according to claim 8 wherein said axial and radial stems define an L-shaped section of said retainer.

10. A retainer according to claim 9 having a single circumferential split.

* * * * *